United States Patent [19]

Kraatz et al.

[11] 3,974,787

[45] Aug. 17, 1976

[54] FABRIC POSITIONING HOLDER

[75] Inventors: Gerald A. Kraatz, Highland Park; Ronald A. Godsen, Lombard; Herbert M. Gunner, Jr., Oak Forest; Michael N. Tranquilla, Elmhurst, all of Ill.

[73] Assignee: Union Special Corporation, Chicago, Ill.

[22] Filed: Jan. 22, 1975

[21] Appl. No.: 543,099

[52] U.S. Cl. ..... 112/121.12; 112/207

[51] Int. Cl.[2] ..... D05B 21/00

[58] Field of Search ..... 112/121.12, 121.15, 112/121.11, 207, 70

[56] References Cited

UNITED STATES PATENTS

| | | | |
|---|---|---|---|
| 3,742,879 | 7/1973 | Schaefer et al. | 112/121.12 |
| 3,752,098 | 8/1973 | Logan | 112/121.12 |

*Primary Examiner*—H. Hampton Hunter

[57] ABSTRACT

A fabric positioning holder is automatically moved by computer directed first and second stepper motors. A force generating means urges the jaws of the fabric positioning holder against the throat plate with total pressures which exceed 10 lbs. The stepper motors are, therefore, mounted such that their mass can be employed to overcome the shock forces associated with rapid movement of the holder.

11 Claims, 12 Drawing Figures

FABRIC POSITIONING HOLDER

This application is related to and, for further background information reference should be made to the following co-pending applications:

William P. Herzer et al: Ser. No. 496,748 filed Aug. 12, 1974, Ser. No. 540,933 filed Jan. 14, 1975, and Florian F. Yanikowski: Ser. No. 496,749 filed Aug. 12, 1974, Ser. No. 532,986 filed Dec. 16, 1974, Ser. No. 534,546 filed Dec. 19, 1974, Ser. No. 535,874 filed December 23, 1974.

This invention relates to automatically controlled sewing machines and more particularly to a fabric holder which moves in a predetermined manner with respect to the sewing needle. Sewing machine having automatic controlling means are known in the art, such machines may be controlled by cam means or computer means. As is apparent, a fabric holder or clamp is moved through a predetermined sequence of steps in coordination with the needle. That is, the automatic control system directs the positioning of the fabric holder in conjunction with the actuation of the needle means. With the advent of more sophisticated automatic controlling means, attempts are being made to design machines which are capable of forming a large variation of functions with a minimum amount of human intervention. Specifically, this has necessitated redevelopment and redesign of the fabric holder to allow the employment of the multitude of fabrics in combination with various stitch designs.

In order to achieve such objectives, it is necessary to provide a fabric holder which is capable of exerting substantial holding or clamping pressure against the fabric, whereby urging it against the throat plate, and still be rapidly repositionable. As is apparent, high clamping pressures resulted in substantial friction between the fabric holder and the throat plate. This undesirable feature of high frictional forces between the fabric holder and the plate had to be overcome and yet not result in a design which was unduly clumsy or bulky or of a great mass. The mass, as is apparent, would result in detrimental inertia problems, an unduly bulky design could prevent the necessary positioning of fabric to achieve a desired sewing pattern. It has been determined that the closer the fabric is to the throat plate and the greater the control thereof, the better the stitch can be formed. The same is true with regard to being able to position a large bulky piece of fabric in any particular manner adjacent to the sewing needle.

It is therefore an object of this invention to provide an automatically controlled fabric holder capable of exerting substantial pressures on a throat plate. Yet another object of this invention is to provide a fabric holder which provides substantial clearance under the overhanging arm of the sewing machine. Still another object of this invention is to provide a low inertia fabric holder which positions and holds the fabric to allow the formation of better sewn stitches. Another object of this invention is to provide a cable actuated fabric holder wherein there is no reverse bending of the cable. Yet another object of this invention is to provide a cable driven fabric holder wherein the cable experiences a minimum of distortion creating forces. Another object of this invention is to provide a fabric holder driven by motor means which are mounted to dampen shock associated with actuation and deactuation. Still another object of this invention is to provide a cable actuated fabric holder wherein the cable has a low preload. Another object of this invention is to provide a fabric holder actuated by motor means which are part of a mass controlled system.

The present invention resides in a fabric holder capable of clamping a fabric material against a throat plate and then moving it through a given sequence of X — Y coordinates with respect to a stitch forming instrumentality such as a needle. First and second stepper motors are employed to guide the fabric holder through the sequence of X — Y steps.

In the preferred embodiment a series of cable means are employed to transfer force from the stepping motors to the fabric holder. The stepping motor means are mounted whereby the mass thereof can be employed to dampen shock associated with the stopping and starting thereof. A force generating means, such as a pneumatic cylinder comprises an element of the fabric holder in a manner whereby it follows the movement of the holder.

Figure 1:
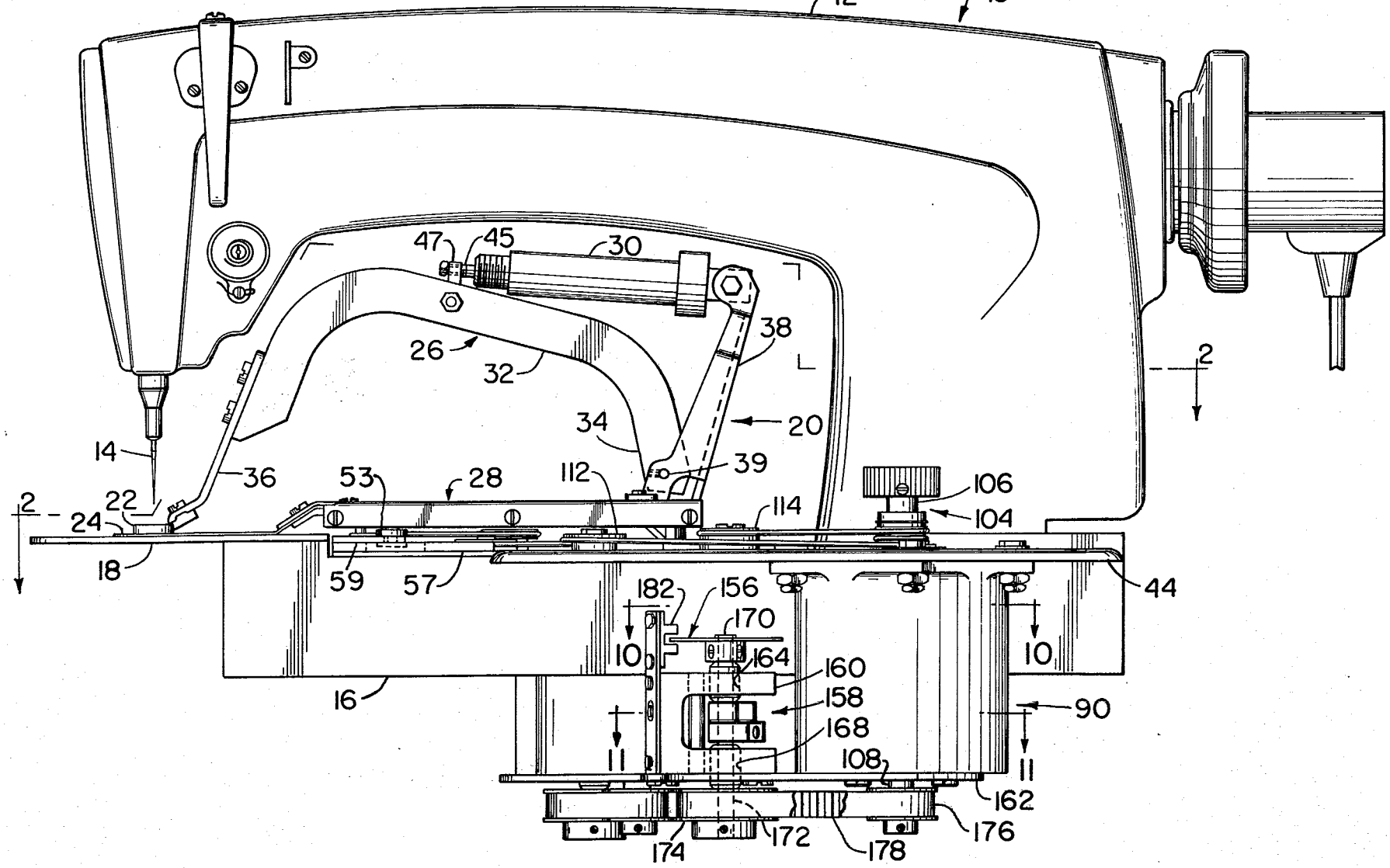
FIG. 1 is a side view of a sewing machine incorporating the present invention therein.

Referring now to the drawings and more particularly to FIG. 1, there is shown a sewing machine 10 embodying thereon the invention. The sewing machine 10 includes an overhanging arm means 12, a stitch forming instrumentality which vertically reciprocates such as the sewing needle 14, the frame means 16 and a throat plate 18. As is apparent, the sewing machine is an instrumentality which is known in the art and therefore no further description will be devoted thereto. Further, the computer means and related electrical circuitry which automatically control the sewing machine and fabric holder are described in the above-mentioned patent applications and thus no further description will be devoted thereto.

The fabric holder means 20 is designed whereby the fabric clamped by the upper jaw means 22 and lower jaw means 24 can be moved in an X ' Y coordinate system as well as subjected to forces substantially greater than those employed in the prior art. Included in the fabric holder means 22 and 24 are a clamping means 26, and a lever means 28. Force is delivered to the clamping means 26 in the preferred embodiment by a solenoid actuated pneumatic cylinder means 30. The actuation or the deactuation thereof being a part of the movement controlled by the automatic control means. The clamping means 26 includes a generally U-shaped elongated bar means 32 which is pivotally carried on the lever means 28 at a first end 34 and securely carries the upper jaw means 22 at a second end means 36. A support member 38 is secured to the lever means 28 whereby providing support for a cylinder means 30 such that the reciprocation of the piston therein, force can be exerted on or removed from the U-shaped channel means 32. A pin means 39 pivotally carries the bar means 32 on support means 38. A series of nut and bolt or fastening means 41 secure the clamping means 26 to the lever means 28. Elongated slot means 43 being provided to allow movement and repositioning of the clamp means 26 along the Y axis. The rod means 45 of the cylinder means 30 has a threaded portion which is associated with a corresponding threaded portion on the bar securement bracket 47. By movement of the rod means with regard to the bracket it thus, becomes possible to vary the maximum height of the upper jaw means 22 above the throat plate 18. As is apparent, the generally arcuated clamping means 26 is mounted on the lever means, and follows all movement thereof. As such it is capable of delivering force via the upper jaw means 22 and yet provide substantial area under the overhanging arm means 12 wherein the work fabric can be positioned or maneuvered.

Figure 4:
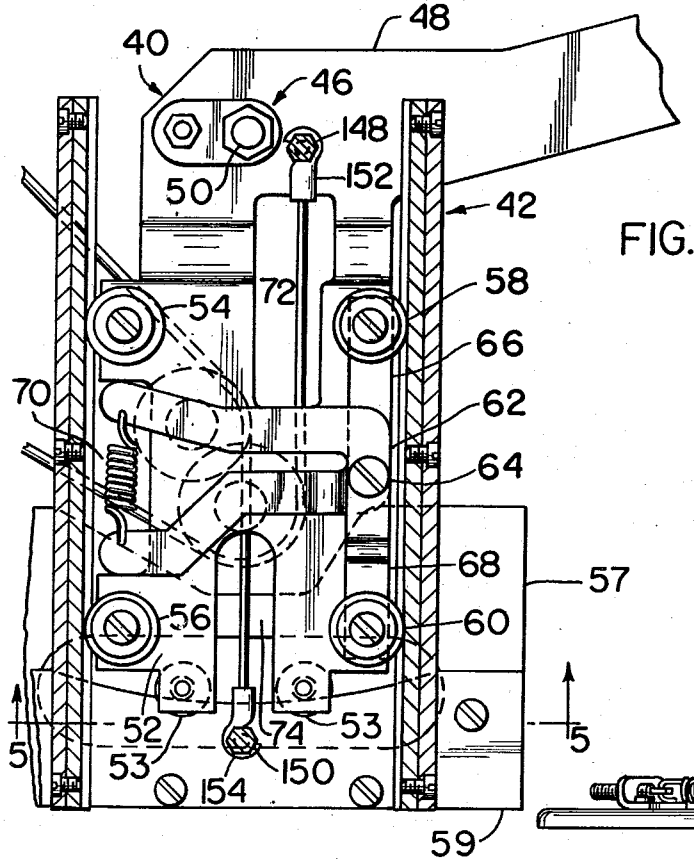
FIG. 4 is a partial broken away view of the lever element of the fabric holder.
Figure 5:
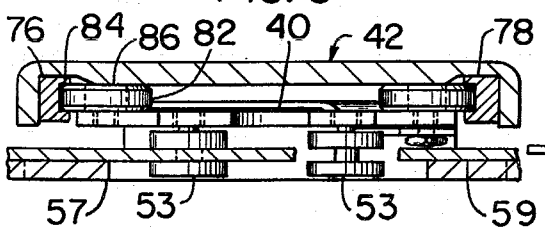
FIG. 5 is a cross sectional view taken on the line 5—5 of FIG. 4.

The lever means 28 includes a frame means 40 and an extensible bracket means 42 as shown in FIGS. 4 and 5. The frame means 40 carries the extensible bracket means 42 and in turn is supported on cover plate 44. In the preferred embodiment, the supporting means comprises a pivot pin assembly means 46, centrally located on the lever means 28 and being secured by rear end means 48 to the cover plate means 44. Thus, the entire fabric holding means 20 is free to pivot around shoulder screw 50 of assembly means 46. As is apparent, shoulder screw 50 must also be capable of resisting forces in a vertical plane generating by the action of the clamping jaws against the throat plate 18. This restriction of vertical movement must be such that no hindrance of the pivotal movement results. Adjacent the leading or second edge means 52 and extending downwardly therefrom are a series of shoulder screw means 53 which are carried in an appropriately designed area 57 below the level of the cover plate 44, secured to the cover plate 44 and extending over the top portion of the shoulder screw means 53 is a bracket means 59. A bearing surface is provided between the shoulder screw means 53 and the bracket 59 whereby the shoulder screws are free to slide therein as the fabric holder pivots around pin means 50. Without the provision of the shoulder screws and channel means, when the upper jaw means 22 exerted pressure downwardly against the throat plate 18, it may have been possible to bend the lever means 28 in an upward direction away from cover plate 44. As is apparent, such measures are not necessary in fabric holding clamps wherein only minimal pressures are exerted by the clamping jaws against the throat plate.

Mounted on the frame means 40 and a generally rectangular pattern are first, second, third and fourth disc shaped ball bearing means 54, 56, 58 and 60. Bearing means of 54 and 56 are carried directly on the frame means via shaft means which journal each bearing. The other two bearing means 58 and 60 are carried by a scissor-like device 62, which is in turn pivotally mounted via pin 64 to frame means 40. As is shown in FIG. 4, the scissor-like means 62 includes two L shaped lever means 66 and 68 joined generally at their apexes. The bearing means 58 and 60 being carried at one set of ends while a spring means 70 continuously urges the other two ends toward each other. Channel means 72 and 74 are also provided in the body of frame means 40 as will hereafter be more fully explained.

The extensible bracket means 42, carrying at a first end the lower jaw means 24, is slidingly carried on frame means 40. The sliding is achieved by the employment of generally rectangularly grooved track means 76 and 78 which are positioned in the outer edges thereof as shown in FIG. 5. As is apparent, the guide track means 76 and 78 are designed to cooperate with the bearing means 54 through 60 such that the extensible bracket 42 can move freely while exerting both horizontal and vertical loads on the bearing means 54 through 60. The scissor-like means 62 which carries the bearing means 58 and 60 allows for quick assembly and the ability to vary the horizontal forces by the simple replacement of the spring means 70. The engagement of the extensible bracket means 42 with the bearing means, such as 56, is designed such that the maximum amount of the load bearing surface, in each direction, of the bearing is employed. That is, channel 76 for example, is generally rectangular thus allowing the maximum contact with the flat outer edge surface 82 of the bearing 56 while the outer race 84 of lever 42 rests directly on the flat top surface 86.

Figure 2:
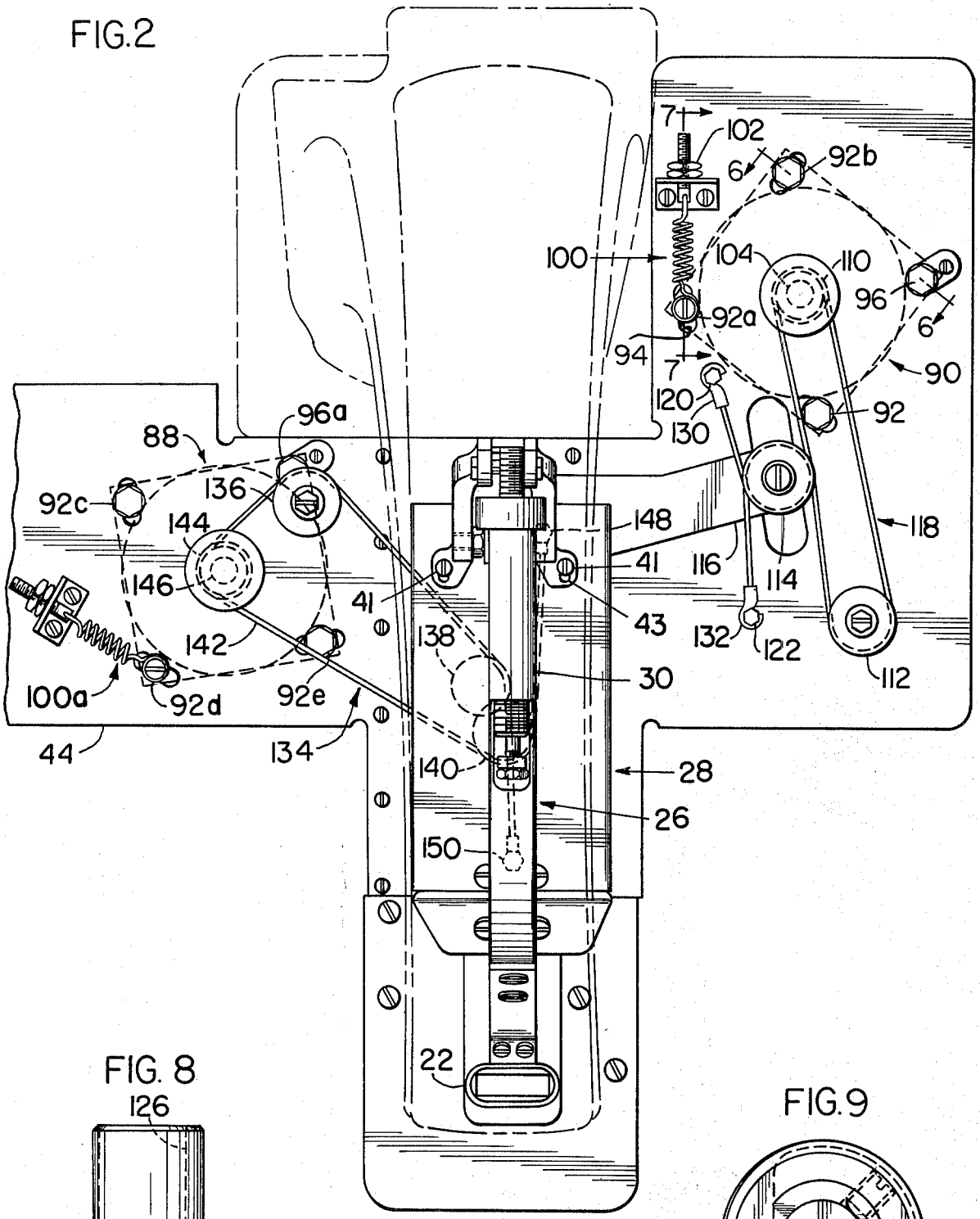
FIG. 2 is a top view of FIG. 1 taken generally along the line 2—2.
Figure 3:
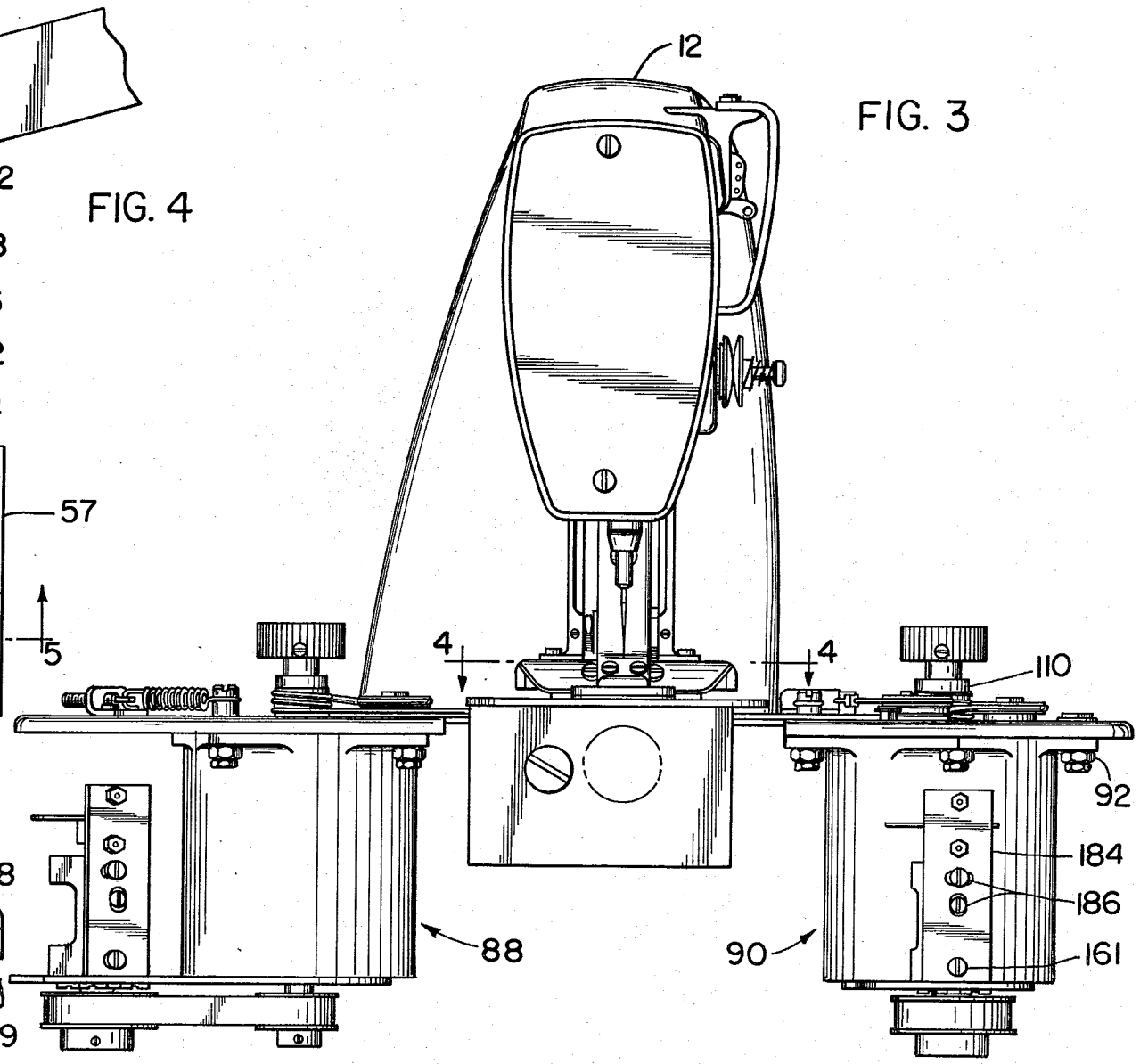
FIG. 3 is a front elevational view of the sewing machine incorporating the present invention.

Referring now to FIGS. 2 and 3 wherein are shown first and second stepping motors 88 and 90, the full understanding of the nature of the stepping motors as well as their mode of actuation is fully set forth in the previously listed patent applications, and for a complete understanding thereof reference should be made thereto. It suffices to say that the stepping motors 88 and 90 respond to electrical impulses to produce a given and discrete amount of output. This output in turn is carried by a force transfer means to cause the fabric holder means to be moved in either the X or Y direction or both. The X — Y coordinate system as employed herein is such that the Y axis is parallel to the major axis of the sewing machine, with the X axis being perpendicular thereto. The point at which the needle passes through the throat plate is defined as O,O in the coordinate system. Thus, when the extensible lever 42 moves in or out, it moves along the Y axis of the coordinate system, while when the fabric holder pivots around pin 50 it is said to be moving along the X axis. As shown in FIG. 2, the stepping motors 88 and 90 are carried on the cover plate 44 by the provision of a mounting assembly 91. The assembly includes nut and bolt means such as 92 which is secured through apertures in both the cover plate 44 and in the motor means 90. In a preferred embodiment a nylon washer means 97 can be provided between the head of bolt 92 for example, and the top surface of plate 44. This reduces the coefficient of friction and wear between these means. It will be noted that bolt means 92 and bolt means 92*a* through "*e*" are provided with elongated slots or apertures such as 94. A second set of nut and bolt means 96 and 96*a* are provided with aperture means of a diameter slightly larger than that of the bolt means which passes therethrough. As a result, the stepping motor means, for example 90, can be pivoted around nut and bolt means 96 a distance corresponding generally to the length of elongated slot such as 94.

Associated with bolt means 92*a*, located generally on the opposite corner from bolt means 96, is a tension means 100 which continuously urges the means 92*a* into one corner of the elongated slot means such as 94. In the preferred embodiment tension means 100 is a spring means having one end secured to nut and bolt means 92*a* and a second end means secured to the cover plate 44. The second end means, such as 102, can also be provided with an adjusting means whereby the force which the spring is exerting can be increased or decreased. As is shown, this device is a threaded bolt having a nut thereon. A substantially identical device 100*a* is provided in conjunction with stepping motor means 88.

By mounting the elements as described, a mass controlled system is achieved because the driving is at a frequency above the natural frequency of the system. Considering the formula $\frac{1}{2\pi}\sqrt{K/M}=fn$ where $fn$ is the natural frequency of the system, $K$ is the stiffness of the spring 100*a* for example, and $M$ is the mass of the motor 88. As is known for driving force frequencies below $fn$, the mass will follow the driving force while for frequencies above $fn$ the mass doesn't follow the driving force and the displacement thereof can be minimized. With other types of systems which attempt to achieve these results without employing the mass of the motor, there must be a preload on the cable which is greater than the maximum dynamic load thereon. This introduces factors which tend to distort the design of the assembly and cause excessive cable difficulties. As is apparent, for driving force frequencies above $fn$ the preload on the cable need not be greater than the time average of the cable load.

Figure 8:
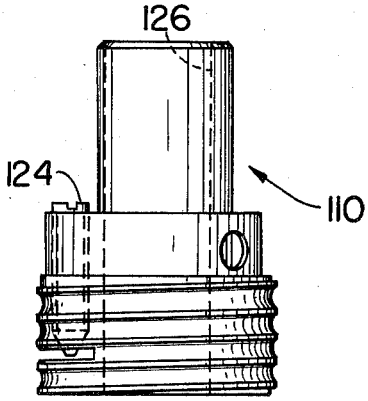
FIG. 8 is a partial view of a stepping motor pulley.
Figure 9:
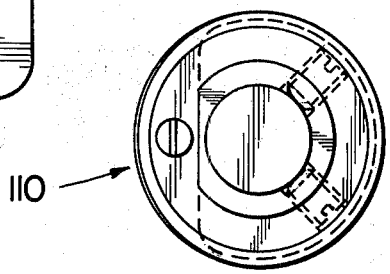
FIG. 9 is a generally top view of the stepping motor pulley as shown in FIG. 8.

The stepping motors are provided with output shafts such as 104. The output shaft 104 has a first and second end means 106 and 108. In regard to the output shaft, discussion hereof will be limited to shaft means 104 with the understanding that subject discussion is applicable to the output shaft associated with motor 88. The top end 106 is provided with a pulley means 110 as more specifically shown in FIGS. 8 and 9. In the preferred embodiment force is transferred from the output shaft 104 to the fabric holder means 28 by a cable, however, transfer may be by other means, such as a timing belt, rack and pinion means or other related linkage means. In the preferred embodiment, free turning roller pulley means 112 is mounted on cover plate 44. A second series of free turning roller pulley means 114 and 115 are provided, associated with a dog leg means or lever means 116. As shown, pulleys 114 and 115 are stacked one on the other and share a common support shaft. As shown in FIG. 4, lever means 116 is secured to the rear portion of frame means 40 such that any movement thereof is transferred to frame means 40 causing movement thereof along the X axis. The cable means 118 having first and second end means 120 and 122 secured to cover plate 44, is strung between the above listed pulley and free turning roller pulleys. In the preferred embodiment the cable means 118 is passed two and a half times around pulley means 110 and secured in placed by lock screw 124 by the exertion of force on the section of the cable carried in groove 126. The multiple turning and locking of the cable around pulley 110 is necessary to insure the accurate transfer of force therebetween. The cable makes a one-half turn around free turning pulley 112 and a one-half turn from the right and one-half turn from the left around pulleys 114 and 115, each turn as is shown in FIG. 1 being in a different groove. The hook means 130 and 132 secured to the ends of the cable means 118 are fastened over suitable means securing them to the plate means 44. In practice the cable means 118 is of a length such that when strung, as shown in FIG. 2, it has a tension just sufficient to keep bolt means 92*a* about centered in the elongated slot against the force of the spring means 100. Thus, the bolt 92*a* in a sense floats within the slot and should not touch either the front or back thereof.

As is apparent, when the stepping motor means rapidly stops and starts certain shock wave forces will be set up in the cable means 118. It is the purpose of the stepping motor mounting means 91 and tension means 100 to employ the mass of the motor to dampen these shock waves. In order to avoid inertia problems associated with the cable and the fabric holder, the mass of these items is maintained at a minimum. Thus, they are not good means to spring load, in order to overcome the shock forces. This is especially true when the clamping pressure of the jaws on the throat plate is of the level of 10 lbs. and above. In operation when stepping motor 90 is actuated to rotate the output shaft in a clockwise manner, force is delivered to frame means 116 by the cable means 118 causing the plate to be drawn toward the output shaft means 104. Since lever means 116 is secured directly to and carried on frame means 40, the entire assemblage pivots around pin means 50. As a result the upper and lower jaws are pivoted to the right. If the stepping motor means 90 is actuated to cause output in a counterclockwise manner, the jaws are correspondingly moved to the left, each of these movements being along the X axis.

As shown in FIG. 2, a second force transfer means 134 is associated with stepping motor 88. As was previously stated, the stepping motor means 88 is spring mounted in the same manner as stepping motor 90. The force transfer means 134 includes a series of free turning pulley means 136, 138 and 140. With each cable means 142 passes only a part of a turn there around. The pulley means 144 associated with the output shaft 146 of stepper motor 88 has the cable passed there around two and a quarter times and locked, identically as is pulley 110 of stepper motor 90.

Referring now to FIGS. 1 and 4, the first and second support means 148 and 150 are shown fixed to the bottom of extensible bracket means 42 and extending downwardly therefrom. The ends of the cable means 142 are provided with hook fixture means 152 and 154 which are securable over the support means 148 and 150. As is apparent, any suitable securing means could be employed to connect the ends of the cable to the bottom or other suitable portion of the extensible bracket means 42. In operation the output shaft 146 rotates in either a clockwise or counterclockwise direction causing the extensible bracket to be slid forwardly or backwardly in the Y direction. For example, if the output shaft 146 rotates in a clockwise direction, cable 142 will be drawn there around with the resulting movement of pin 148 toward pulley 140. As is apparent, pulleys 136, 138 and 140 are pivotally secured to the cover plate means 44 and thus not involved in any movement of the fabric positioning holder. During this clockwise movement the entire fabric positioning holder is slid straight out toward the front of the machine a predetermined amount. As is apparent, when the output shaft 146 is rotated in a counterclockwise direction the pin means 150 moves toward the pulley means 140 and the entire fabric positioning apparatus is moved toward the rear or back of the machine.

Secured to the bottom portion of the output shaft of the respective stepping motors 88 and 90 and being connected in a following manner are homing device means 156 and limit means 158.

Figure 10:
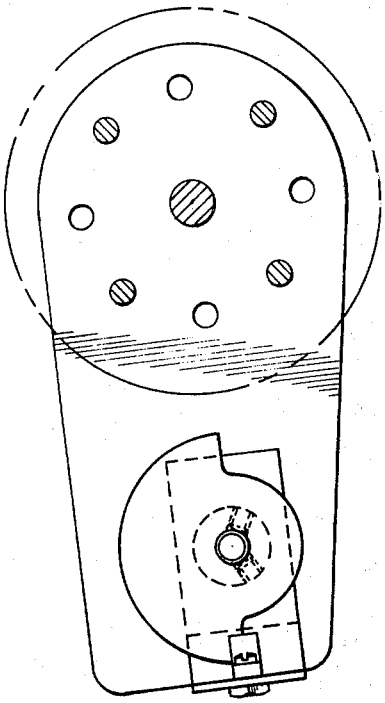
FIG. 10 is a partial view of the homing assembly taken along the line 10—10 of FIG. 1.

For a complete understanding of the homing device, reference should be made to the above-mentioned two co-pending applications, Ser. Nos. 496,748 and 496,749. Very simply, the homing device at the end of a given sewing function causes the fabric positioning holder means 28 to return to a predetermined position. In the preferred embodiment the position is such that the jaw means 22 and 24 are centered around the point O,O, of the X — Y coordinates, but it must be understood that any point may be chosen as "home." Reference will not be made to the homing and limiting assemblies associated with stepping motor 90, with the understanding that it applies equally well to those assemblies associated with stepping motor 88. A generally U shaped frame means 160 is carried on a plate means 162 which in turn is fixedly secured to the bottom of stepping motor 90. The frame means 160 is provided with suitable apertures 164 and 168 which in turn are journaled by a shaft means 170 carrying at its bottom end 172 a pulley means 174. The bottom end 108 of output shaft means 104 of stepping motor 90 is also provided with a pulley means 176. Extending between these two pulley means is a timing belt 178 whereby movement and force is accurately transferred therebetween. As a result, it is apparent that the movement of output shaft 104 can be closely monitored in the movement of shaft means 170. Secured to the top edge of shaft 170 is the homing assembly means 156 which as shown in FIG. 10 includes a cutaway disc means 180 and a photoelectric device 182. The photoelectric device 182 is mounted to a plate member 184 which in turn is secured to the housing or frame means 160 via screw means 161. As is apparent, in FIG. 3 the attaching screw means 186 journal elongated slots in the plate means, thus within a certain degree the plate and photoelectric subject device can be finely positioned to achieve the exact return of the fabric positioning holder to a predetermined point relative to clamp jaws 22 and 24.

Figure 11:
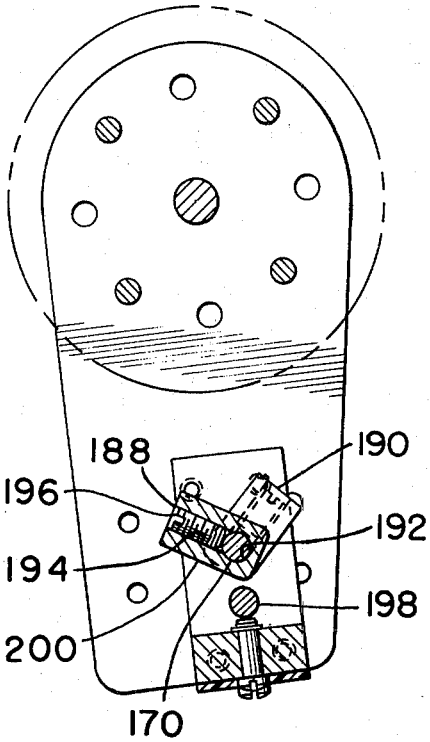
FIG. 11 is a partial view of the positive limiting means taken along the line 11—11 of FIG. 1.
Figure 6:
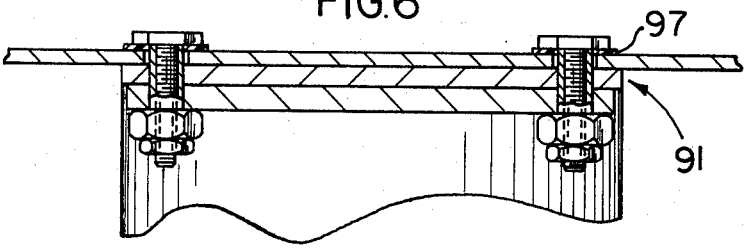
FIG. 6 is a partial cross sectional view of the stepping motor mounting means taken generally along the line 6—6 of FIG. 2.
Figure 12:
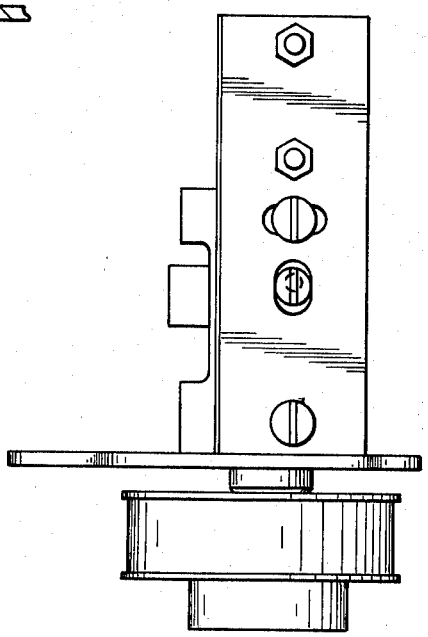
FIG. 12 is a view of the plate member to which the photoelectric and abutting means are mounted.
Figure 7:
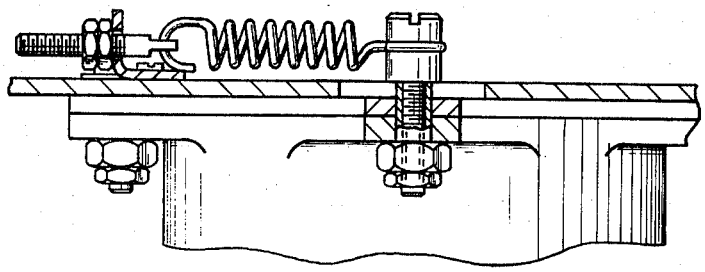
FIG. 7 is a partial cross sectional view of the biasing means taken generally along the line 7—7 of FIG. 2.

The limiting assembly 158 as shown in FIGS. 1 and 11 include first and second abutting means 188 and 190. These assemblies being generally identical reference and discussion will be limited simply to member 188 with the understanding that it applies equally well to member 190. Abutting member 188 includes a first bore means 192 passing completely there through and a second bore means 194 generally perpendicular to and intersecting bore 192, however, not extending there through. Bore means 192 is journaled by shaft means 170, while bore means 194, having a threaded inner surface, is provided with a threaded pin means 196. Directly adjacent shaft means 170 is a contact rod means 198. Referring now to FIG. 11 once the abutting member 188 is journaled by shaft means 170 it can be positioned in fixedly secured by virtue of pin means 196 in any given position. This position will be chosen so that when shaft means 170 is rotated through some given angle the side surface 200 of abutting means 188 will abut contact shaft means 198 such that no further rotation of the shaft is possible. As is apparent, since output shaft 104 is tied via the timing belt 178 to shaft 170 further movement of the stepping motor is prevented once this abutting relationship is achieved. As a result of being able to limit the movement of the output shaft 104 of stepping motor 90 via the quick and simple adjustment of the block means 188 and 190 various types of jaw means, such as 22 and 24, can be employed without fear of there collision with the needle means 14. Simply by readjusting the stop means associated with the two stepping motors to cause limitation of the stepping motors with different sized jaw means a safety feature is built in which is not dependent upon any electrical means. That is, electrical disturbances, operator error in the programming of the device which controls movement of the stepping motors, etc., can be avoided by the employment of these simple, easily adjustable limiting means.

There has thus been described a low inertia fabric positioning holder which operates at substantially high fabric engaging forces. Stepping motors are mounted, one on each side of the sewing machine, to allow the use of a minimum amount of force transferring cable. Thus, error due to cable distortion and problems of cable wear are reduced.

The overall shape of the holder structure follows the sewing machine arm to allow a substantial open area thereunder. In order to provide this open area and yet achieve high fabric engaging forces while moving the clamping jaws in the X and Y coordinates, the rear end of the holder is pivotally secured to the sewing machine while the leading edge is movingly anchored.

A mounting assembly is provided which carries the motors such that a mass controlled driving system exists. This is because the driving is at a frequency which is above the natural frequency of the system.

Thus it is apparent that there has been provided, in accordance with the invention, a fabric positioning holder that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An automatic sewing machine including a sewing machine having a sewing needle, a storage element means containing information, an electrical means for reading said information in a predetermined sequence and translating the information into electrical output signals representative thereof wherein the improvement comprises:

a high pressure holder means pivotally secured to said sewing machine, including a lever means and a clamp means, carried thereon;

first and second stepping motor means being responsive to certain of said electrical output signals resulting in a predetermined amount of output actuation;

mounting means carrying said motor means on said sewing machine, one on each side thereof, including, bracket means pivotally secured to said sewing machine and tension means urging said bracket into a predetermined position; and force transfer means extending between said stepping motor means and said extensible lever means, and acting against said tension means.

2. The automatic sewing machine of claim 1 wherein said lever means includes:

a frame means having first and second end means, said first end being pivotally secured to said sewing machine and having an extensible bracket means carried thereon and extending from said second end.

3. The automatic sewing machine of claim 1 wherein:

said force transfer means includes a first cable means transferring force in a single plane to said extensible bracket and a second means operative to transfer force to said lever means.

4. The automatic sewing machine of claim 2 wherein said lever means includes:

a slide means operative to allow said extensible bracket to move in a first plane with respect to said frame including a bearing means exerting force on said extensible bracket in at least two planes.

5. The automatic sewing machine of claim 4 wherein:

said frame means includes a means operative to movably secure said second end means to said sewing machine;

said extensible bracket includes a fabric supporting means; and said clamp means includes a fabric engaging means cooperating with said fabric supporting means, and a means mounted thereon operative to force said fabric supporting means against said fabric engaging means.

6. An automatic sewing machine including a sewing machine having a sewing needle, a storage element means containing information, an electrical means for reading said information in a predetermined sequence and translating the information into electrical output signals representative thereof wherein the improvement comprises:

a high pressure holder means pivotally secured to said sewing machine;

first and second motor means responsive to certain of said electrical output signals resulting in a a predetermined amount of output actuation;

cable means extending between said motor means and said holder means whereby force is transferred therebetween; and mounting means carrying said motor means and having a spring, wherein the following relationship exists $\frac{1}{2}\pi \sqrt{K/M} = fn$.

where $M$ is the mass of the motor means, $K$ is the stiffness of the spring and $fn$ is the natural frequency of the system, such that the value $fn$ is below the value of the driving force frequencies.

7. The sewing machine of claim 6 wherein:

said motor is pivotally mounted;

said cable means engages said motor exerting force thereon; and said spring means engages said motor means exerting force thereon against said cable means.

8. The sewing machine of claim 6 wherein:

said high pressure holder means includes a generally horizontally extending lever means, and an arcuated clamp means.

9. The high pressure holder means of claim 8 wherein:

said lever is mounted on said sewing machine for movement in a series of planes and said clamp means is mounted on said lever; and a force generating means extending between said lever and said clamp.

10. The high pressure holder of claim 8 wherein:

said lever is pivotally secured to said sewing machine at a first end and movable anchored at a second end.

11. A work positioning means employed in association with a work performing means having a storage element means containing information, an electrical means for reading said information in a predetermined sequence and translating the information into electrical output signals representative thereof, said work positioning means holding and moving an item, work being done thereon by said working performing means, comprising:

a high pressure holder means pivotally secured to said working performing means, including a lever means and a clamp means, carried thereon;

first and second stepping motor means being responsive to certain of said electrical output signals resulting in a predetermined amount of output actuation;

mounting means carrying said motor means on said work performing means, including, bracket means pivotally secured to said work performing means and tension means urging said bracket means into a predetermined position; and force transfer means extending between said stepping motor means and said extensible lever means, and acting against said tension means.

* * * * *